US005446535A

United States Patent [19]

Williams

[11] Patent Number: 5,446,535

[45] Date of Patent: Aug. 29, 1995

[54] FIREARM NON-FIRING SIGHT ALIGNMENT SYSTEM

[76] Inventor: John H. Williams, 601 Plantation Rd., Goldsboro, N.C. 27530

[21] Appl. No.: 239,699

[22] Filed: May 9, 1994

[51] Int. Cl.[6] ..... G01B 11/26

[52] U.S. Cl. ..... 356/153; 33/234; 33/286

[58] Field of Search ..... 356/138, 153; 33/234, 33/241, 286

[56] References Cited

U.S. PATENT DOCUMENTS 3,787,693 1/1974 Stone ..... 356/153
4,825,258 4/1989 Whitson ..... 356/153
5,040,885 8/1991 Simms ..... 33/241

*Primary Examiner*—F. L. Evans

[57] ABSTRACT

A firearms sight alignment system is provided which allows for the use of a collimated beam light source attached to a housing which binds the light beam with the direction of a firearm barrel. This light source thus provides a point at which to adjust the sighting apparatus of the firearm while the light source is shining upon an object some distance in front of the firearm barrel. The light source is aligned by a simple housing mechanism mounted to either a mandrel which is inserted into the bore of the firearm barrel or from a bracket attaching the light source to the barrel and alignment therewith.

3 Claims, 4 Drawing Sheets

FIREARM NON-FIRING SIGHT ALIGNMENT SYSTEM

BACKGROUND OF THE INVENTION

The present invention relates to a system and device allowing accurate alignment of firearm aiming apparatus by alignment with a laser beam emitted from a housing attached to the end of the firearm's barrel. This device and the housing attachments allow the system to be adapted to various types and calibers of firearms with very little difficulty and adaption. The prior art includes various bore sighting devices combining the use of a stream of light with adjustment of the firearm aiming apparatus. However, none of the prior art discloses a system employing the attachment of a collimated beam light emitting source in exact cocentric alignment with the firearm's muzzle on the discharging end of the muzzle. Also, this device has the advantage of not requiring any special target apparatus but allows for the system to be employed by pointing the collimated beam of light with the firearm at any convenient object for adjustment of the sighting apparatus.

The use of a mandrel which aligns a housing holding the light source allows for easy adaption to various calibers of firearms. By precise sizing and allowing axial adjustability of the mandrel-housing connection the collimated beam of light can be precisely aligned with the bore of the firearm barrel.

DETAILED DESCRIPTION OF THE PREFERRED EMBODIMENTS

Figure 1:
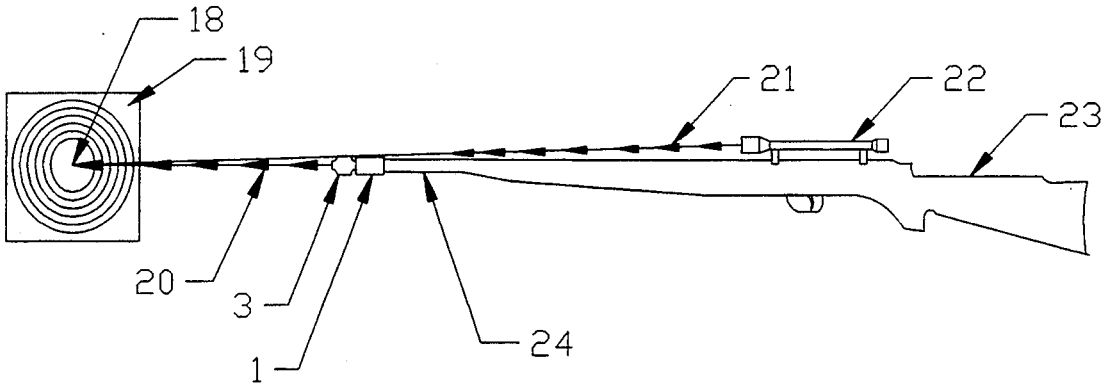
FIG. 1 is a diagrammatic view of elements comprising the present non-firing alignment invention whereby the alignment method is by inserting mandrel into muzzle of gun.
Figure 2:
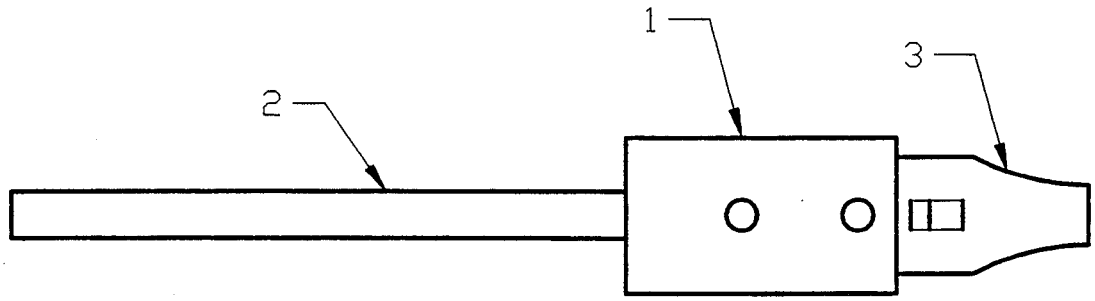
FIG. 2 is a schematic view of the laser cell mounted into its housing with mandrel attached.

FIG. 1 illustrates the present non-firing alignment device 3 mounted within a gun 23 by means of inserting a mandrel 2 attached to housing 1 into the muzzle 24 of gun 23. Housing 1 encompasses laser cell 3. The light beam 20 emitted from laser cell 3 is projected onto target 19. Scope 22 mounted on gun 23 is aligned with respect to target center 18 which is indicated by light beam 20, giving a line of sight 21 through the scope 22 to the target center 18. Thus, the laser cell beam 20 is shown as a distinguishable spot on target center 18 and the scope 22 provides a line of sight directly onto the target 19. The scope 22 is adjusted to bring the line of sight 21 directly onto the laser spot 18 on the target 19. Alignment of gun without scope 22 is attained by adjusting gun-mounted sight to correspond to visual spot on target center 18. The non-firing alignment assembly FIG. 2 is removed from gun muzzle 24 and gun 23 is precisely aligned and ready for firing. The sighting device, optical scope 22 or gun sight, is thus in line with the point previously illuminated by laser light spot which was projected onto target 19.

FIG. 2 comprises laser light cell 3 mounted into housing 1 with mandrel 2 inserted into housing 1.

Figure 3:
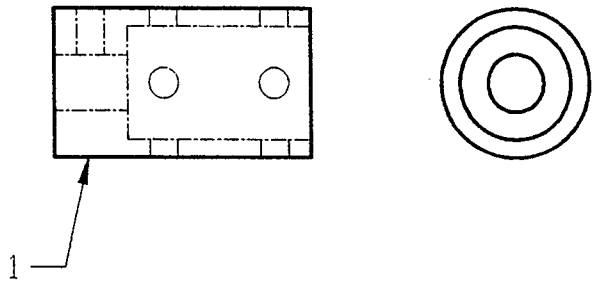
FIG. 3 is a schematic view of the laser cell housing.

FIG. 3 is a diagrammatic view of housing 1.

Figure 4:
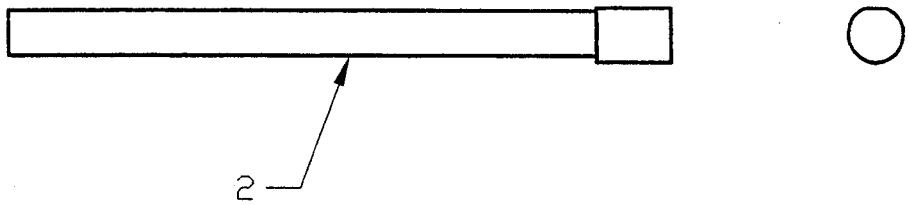
FIG. 4 is a schematic view of one of a plurality of mandrels.

FIG. 4 is a diagrammatic view of one of a plurality of mandrels 2 which are interchangeable with housing 1 but having different shank sizes to fit different caliber guns.

Figure 5:
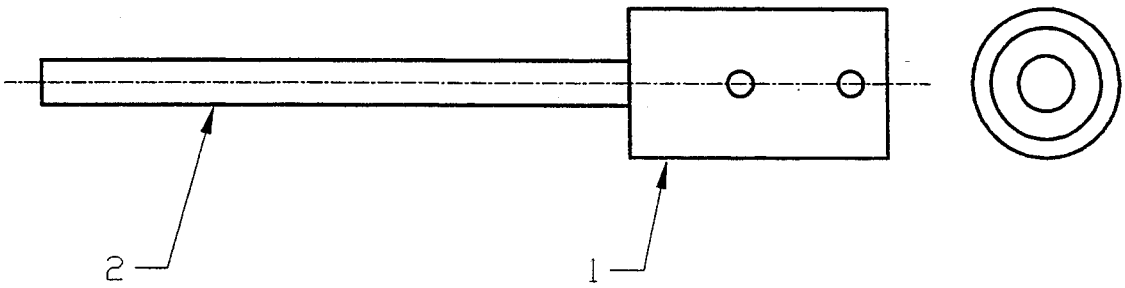
FIG. 5 is a schematic view of a mandrel inserted into the housing.

FIG. 5 is an assembly of housing 1 and mandrel 2.

Figure 6:
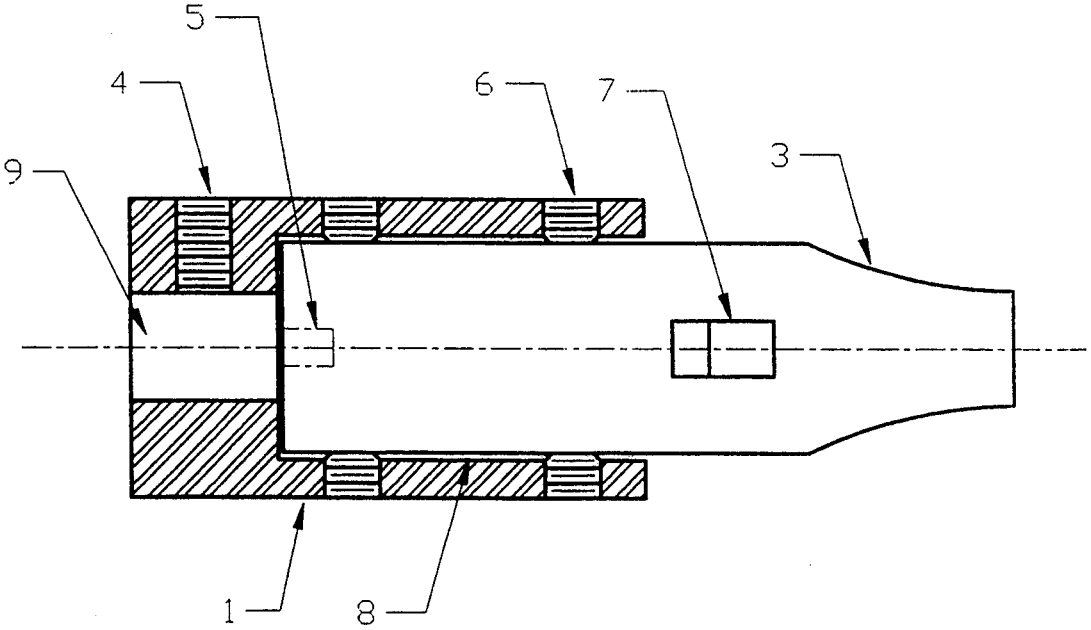
FIG. 6 is a semi-sectional view of the laser cell mounted in the housing.

FIG. 6 is a schematic view of housing 1 encompassing laser light cell 3. The bore of housing 1 is sufficiently larger than diameter of cell 3 to permit space 8 for alignment. Said alignment being accomplished by adjusting screws 6 to attain exact alignment with respect to mandrel bore 9. Housing 1 is mounted onto mandrel and secured by screw 4. Housing 1 is rotated through 360° rotation, during which time adjusting screws 6 are manipulated to bring laser light cell 3 into exact concentric alignment with respect to housing 1. There are sufficient screws 6 to obtain alignment in both vertical and horizontal axes so that after alignment the laser light cell 3 output projected spot on a distant target will be true and concentric. Cell 3 has an internal battery for power source. The battery may be recharged by removing mandrel from housing 1 whereby the charging receptacle 5 is accessible. Recharging may be accomplished by means of a nine volt battery or other source. A switch 7 is used to actuate the laser light source.

Figure 7:
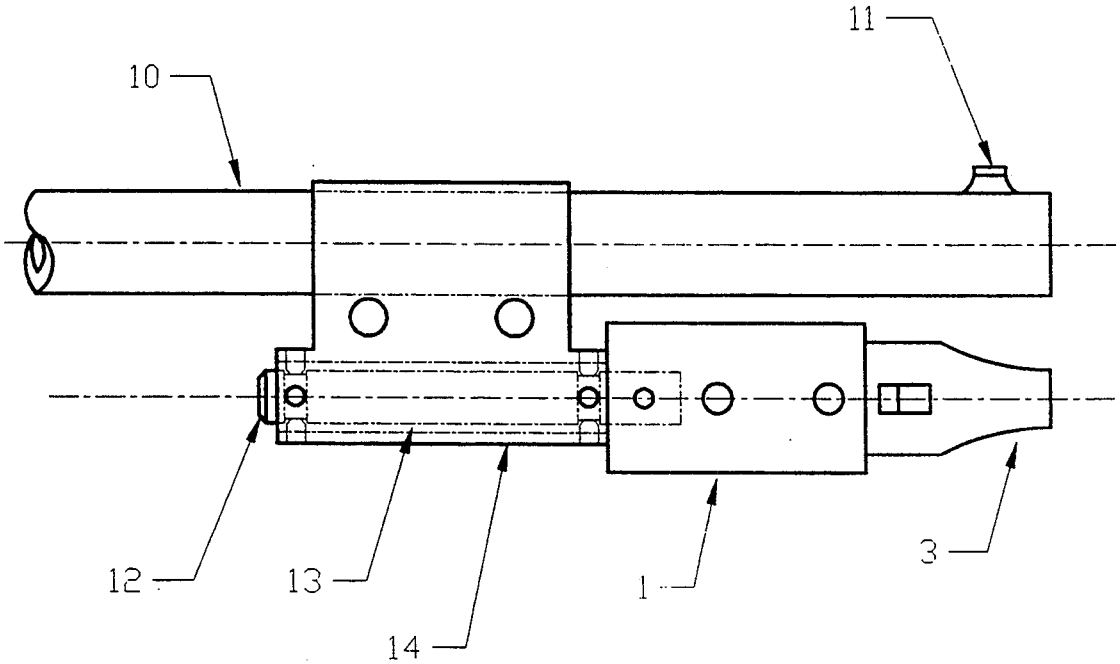
FIG. 7 is a diagrammatic view of elements comprising the present non-firing alignment invention whereby the alignment method is by mounting the laser cell onto the gun barrel.

FIG. 7 is a diagrammatic view of illustrating the present non-firing alignment device 3 mounted onto a gun barrel 10 by means of mounting said device 3 into housing 1. Said housing 1 being same housing as in (FIG. 3) being used interchangeably with mandrel 12 and mandrel 2 (FIG. 4). Housing 1 with cell 3 properly aligned is mounted onto mandrel 12. Said mandrel 12 is positioned into attachment 14 which is mounted onto gun barrel 10 having gun sight 11. Bore of attachment 14 is sufficiently oversized to allow for interstitial space 13 to allow for adjustment of mandrel 12 to obtain perfect alignment of axis of gun barrel 10 and axis of light emission from cell 3.

Figure 8:
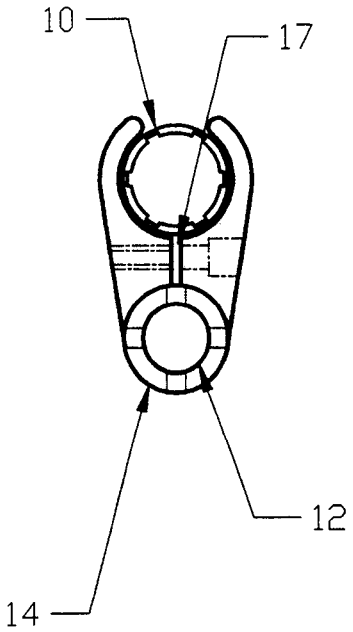
FIG. 8 is a schematic end view of device for mounting laser cell onto gun barrel.
Figure 9:
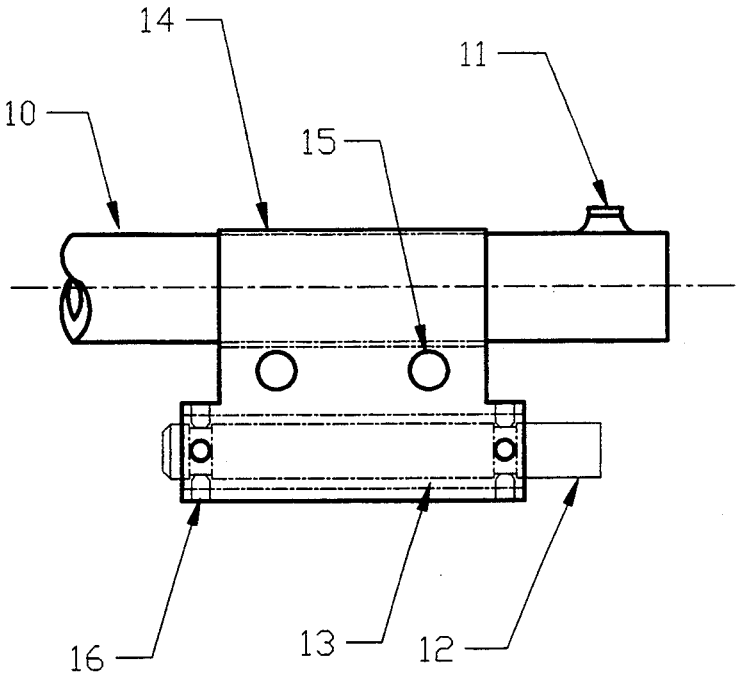
FIG. 9 is a schematic plan view of device for mounting laser cell onto gun barrel.

FIG. 8 & 9 are schematic end and plan views of attachment 14 providing a mounting means for attaching the laser light cell to a gun barrel 10. The attachment 14 is slid over the gun barrel 10 and secured by means of screws 15 by which clamping means are attainable by slot 17. Mandrel 12 is precisely centered in attachment 14 by means of adjusting screws 16 while viewing laser cell projected spot on distant target. Clearance of interstitial space 13 allows for exact positioning on mandrel 12.

Figure 10:
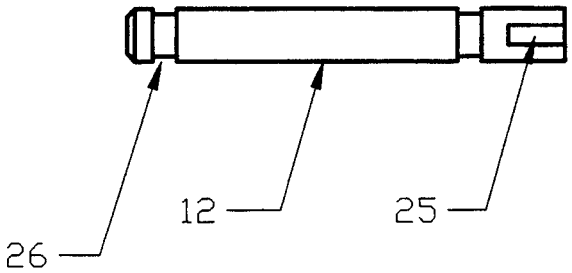
FIG. 10 is a schematic view of mandrel shown in FIG. 9.

FIG. 10 is a schematic view of mandrel 12 providing means by which mandrel 12 is secured to housing 1 (FIG. 6) having a flat area 25 for screw 4 (FIG. 6). Said mandrel 12 also having annular rings 26 reducing diameter of mandrel 12 in area of positioning screws 16 (FIG. 8).

What is claimed is:

1. A firearm bore sight alignment apparatus comprising:

a light source for projecting a beam of visible light, said light source having an internal power supply and a switch;

a mandrel having a first end which fits into the bore of a firearm and a second end, an axis extending from the first end to the second end of said mandrel;

a housing fitted onto the second end of the mandrel and containing said light source, said housing having means to concentrically position the light source therein and securely fix and hold the light source in exact alignment with the axis of the mandrel;

said means being adjusting screws which extend from the housing and engage the light source to permit horizontal and vertical movement of the light source within the housing, said means allowing the light source to be concentrically positioned in the housing by rotating the light source means through 360° and manipulating said adjusting screws until a light beam projected by the light source is seen as a stationary spot on a target.

2. The firearm bore sight alignment apparatus according to claim 1, wherein the light source is a laser light cell.

3. A method of calibrating a firearm's sight or scope to the bore of the firearm, the steps comprising:

inserting a source of collimated, visible light into a first end of a housing, said housing having adjusting screws extending therefrom and engaging the collimated light source to precisely position the collimated light source therein, said collimated light source having an integrated power source and a switch;

calibrating the light source to the housing by projecting a visible light beam from the source onto a target, while rotating the housing through 360° and manipulating the adjustment screws until the projected light beam becomes a stationary spot on the target, thereby positioning the light beam perfectly concentric with the housing;

positioning a mandrel into a second end of the housing opposite the first end, so that the mandrel is concentrically located within the housing;

inserting the mandrel with the housing attached thereto into a barrel of the firearm;

projecting a visible light beam from the light source onto a target;

adjusting the line of sight of the firearm's sight or scope to coincide with the light beam projected on the target; and removing the mandrel from the firearm.

* * * * *